US005404818A

United States Patent [19]

Odom

[11] Patent Number: 5,404,818

[45] Date of Patent: Apr. 11, 1995

[54] INKING SYSTEM FOR PRINTING INK ROLLERS

[76] Inventor: Jimmie L. Odom, Rte. 1, Box 129-A, Bailey, Miss. 39320

[21] Appl. No.: 57,159

[22] Filed: May 6, 1993

[51] Int. Cl.[6] ..... B41F 31/02

[52] U.S. Cl. ..... 101/366; 101/367

[58] Field of Search ..... 101/366, 367, 364, 363, 101/350, 169, 157

[56] References Cited

U.S. PATENT DOCUMENTS

| | | | |
|---|---|---|---|
| 2,232,274 | 2/1941 | Robbins | 101/363 |
| 2,371,223 | 3/1945 | Crafts | 101/363 |
| 3,155,037 | 11/1964 | Haskin | 101/364 |
| 3,312,166 | 6/1966 | Gentile | 101/365 |
| 3,589,287 | 6/1971 | Woessner | 101/363 |
| 4,085,672 | 4/1978 | Grosart | 101/169 |
| 4,466,348 | 8/1984 | Buhrer | 101/169 |
| 4,527,479 | 7/1985 | Dahlgren et al. | 101/350 |
| 4,590,855 | 5/1986 | Schommer et al. | 101/350 |
| 4,864,925 | 9/1989 | Van Kanegan | 101/366 |
| 5,205,216 | 4/1993 | Okamura et al. | 101/367 |

FOREIGN PATENT DOCUMENTS

| | | | |
|---|---|---|---|
| 1037472 | 6/1957 | Germany | 101/150 |
| 0598959 | 3/1948 | United Kingdom | 101/364 |

*Primary Examiner*—Edgar S. Burr
*Assistant Examiner*—Anthony H. Nguyen
*Attorney, Agent, or Firm*—Laurence R. Brown

[57] ABSTRACT

An inking system is provided for flowing ink on the surface of an inking cylinder in a manner that simply confines ink to the working surface of the cylinder without splatter or interference with the cylinder drive system. Thus an ink doctoring chamber is located adjacent the cylinder with a cylinder hugging chamber wall establishing an ink bearing gap over a segment of the cylinder and along its length except adjacent ink free cylinder ends. The ink doctoring chamber has a ramp sloping downwardly to maintaining the ink flow pressure within the confines of the cylinder and away from the cylinder ends. The ink flow gap is terminated at a replaceable flexible planar doctor blade slightly bent to frictionally hold it in place. Thus a simplified circulating ink flow system is provided that need not be sealed off to prevent ink splash or creepage into the printer drive system.

4 Claims, 2 Drawing Sheets

INKING SYSTEM FOR PRINTING INK ROLLERS

TECHNICAL FIELD

This invention relates to printers and more particularly it relates to inking systems for coating a rotatable inking cylinder of a printer system.

BACKGROUND ART

Applying ink coatings to rotatable cylinders of a printer system provides a problem particularly acute in high capacity printers in that ink splashes and is slung from the cylinder by influence of centrifugal force to contaminate bearings and machinery. This has typically in the prior art required shields or enclosures for blocking the spread of the ink.

Representative of this type of prior art is L. H. Haskin, Jr. U.S. Pat. No. 3,155,037, Nov. 3, 1964 for APPARATUS FOR APPLYING FLUID TO A WEB SUCH AS INTAGLIO PRINTING MACHINES, wherein the inking reservoir requires a shaft sealing labyrinth for keeping ink away from the inking roller shaft and bearings. Not only is this expensive but is subject to wear and maintenance, and takes up space along the roller shaft that may be critical.

A further problem in high capacity printers is the provision of a consistent ink coating of optimal thickness on the inking cylinder that is sustained for long printing runs. Thus, ink reservoirs may run dry and ink may vary in performance with operating temperatures, etc. Also, inking requirements change with various press speeds and the style of printing. Therefore a printing system should be adaptable to the variations encountered in practice for optimally feeding ink.

It is therefore an object of this invention to resolve the foregoing problems and to provide an improved inking system that simply and effectively eliminates creeping and splashing of ink and which consistently coats an inking roller under the variations encountered in high capacity printers over long operating periods.

DISCLOSURE OF THE INVENTION

Thus, in accordance with this invention, it has been discovered that an ink doctoring chamber contoured for coating the inking cylinder substantially over its length except for a rim area at the ends of the cylinder adequately confines ink so that it does not splash or sling ink, nor does the ink creep into the cylinder bearings or associated machinery.

The ink feeding system comprises a circulating ink flow path feed ink into a manifold to feed onto the inking cylinder circumference to flow in the direction of cylinder rotation in a confined gap of predetermined thickness limited by a mating ink doctoring chamber surface adjacent to a bottom most segment of the rotating ink cylinder. The gap terminates at a removable doctor blade held by friction in a novel clamping arrangement for ready replacement.

The contour of the ink doctoring chamber surface slopes downwardly near the ends of the inking cylinder, leaving an uninked rim at each end, thus relieving the ink flow pressure sustained by the feeding system and cylinder rotation so that the ink does not reach the drum ends to be slung off by centrifugal force.

Other objects, features and advantages of the invention will be recognized from the following more detailed description, the accompanying drawings and the claims.

BRIEF DESCRIPTION OF THE DRAWINGS

In the accompanying drawings, wherein like reference characters represent similar features throughout the several views to facilitate comparison.

THE PREFERRED EMBODIMENT

Figure 1:
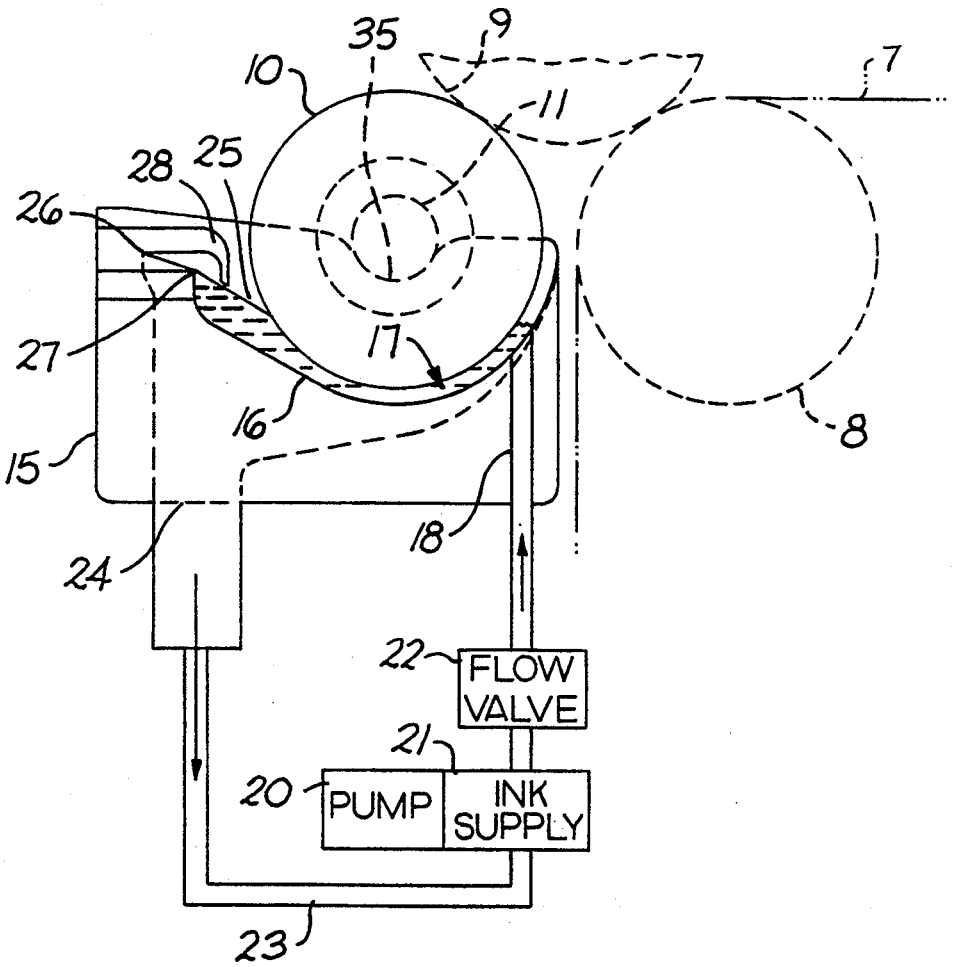
FIG. 1 is a cross section end view sketch, partly in block diagram form, looking into an inking cylinder and the ink doctoring chamber lying underneath the inking cylinder.
Figure 1A:
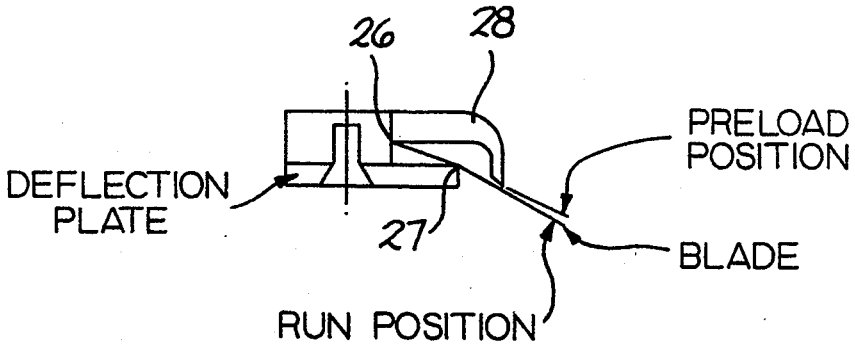
FIG. 1A is an enlarged fragmental view showing the removably mounted doctor blade.

In FIG. 1 a typical printer system arrangement shows a web about cylinder 8 being printed from the text on printing cylinder 9, which receives ink from the inking cylinder 10. The inking roller is journalled about shaft 11 for rotation in a suitable framework.

The ink doctoring chamber 15 is mounted removably. There the bottom contour portion 16 of the .ink doctoring chamber 15 hugs the circumference of the inking cylinder 10 to produce an ink receiving gap 17 of predetermined thickness. Ink flows continuously into this gap 17 from the manifold 18 by means of the circulating pump 20 and accompanying ink supply 21 which replenishes the system for ink used up in the printing process.

The flow valve 22 is used to adjust the ink flow into gap 17 at a controllable rate that fills the gap for the conditions encountered depending upon the rotational speed of the roller, the viscosity of the ink, etc. Ink drained from the ink doctoring chamber 15 is recirculated by way of conduit 23 to provide a continuous flow into gap 17 and out of bottom discharge pipes 24 of the ink doctoring chamber 15.

The friction of the inking cylinder 10 surface carries ink through gap 17 towards the doctor blade 25 in the flow channel about the lowermost segment of the cylinder to assure continuous feed of ink from the drum surface to the print cylinder 9. The doctor blade is a planar blade thin enough to flex, and is held frictionally in place and is replaceable. The doctor blade 25 butt end rests on the inner edge 26 of clamp bar pre-load arm 28 and on the shoulder edge 27 of the deflection plate, about which the blade may flex. Thus the pre-load arm 28 extends downwardly far enough to bend the blade at a small acute angle, typically five degrees. This frictionally holds the blade in place. The roller cylinder moves the blade 25 off the pre-load arm 28 tip and is then free to flex and adjust to the surface of the roller. Under working conditions dynamic forces tend to seat the butt end of the blade in place. The blade then functions in the conventional manner of scraping the excess ink off the surface of inking cylinder 10.

Figure 2:
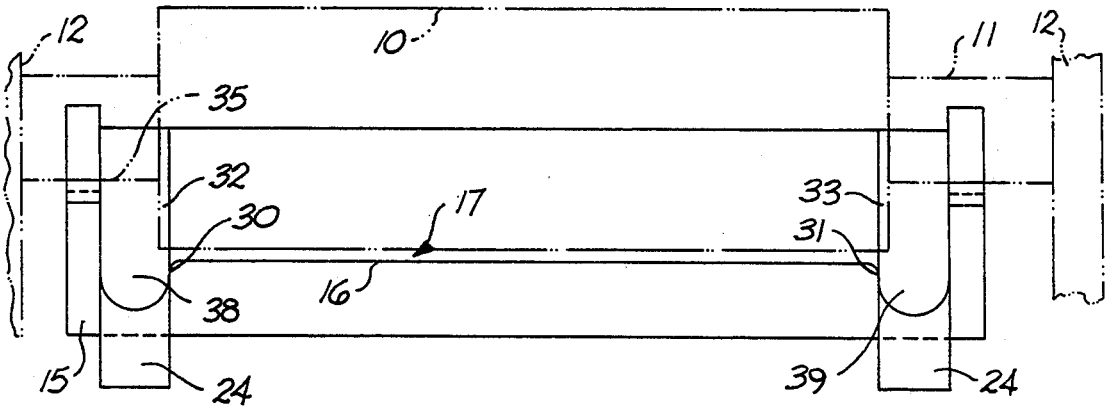
FIG. 2 is a cross section side view sketch, partly in phantom, showing the relationship of the ink doctoring chamber contour with the cylinder inking system that prevents creeping, splashing or slinging of ink.

The ink confining structure may better be visualized by reference to the cross section view of FIG. 2. It is seen that the contour of the ink doctoring chamber 15 bottom at 16 forms the ink gap 17. However that ink gap 17 is relieved at each end of the inking cylinder 10 by the downwardly sloping ramps 30, 31. This permits the excess ink to flow off the sides of the ramps 30, 31 and flow out the discharge pipes 24 without inking the end rims 32, 33 of the surface of the inking cylinder 10. As a result there is no slinging, splashing or creeping of ink in the system, and it runs without getting ink on the cylinder shaft 11 or the cylinder headers.

It is noted that the combined action of the flow of ink under suitable pressure from the pump (20) and the surface drag of the inking cylinder 10 keeps the gap 17 full of ink under pressure in the region shown in FIG. 1 up to the doctor blade. This assures positive inking under any conditions, as long as the flow valve 22 is adjusted to supply the necessary ink. Thus this is an unsealed system. For example the contour of the ink doctoring chamber at the shaft ends of the inking rollers represented by reference character 35 is an alignment bearing.

Figure 3:
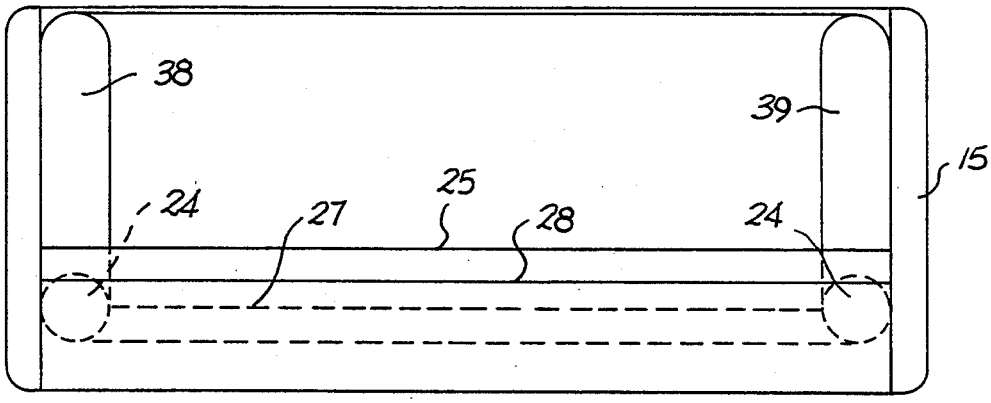
FIG. 3 is a top view of the ink doctoring chamber arrangement in the cylinder rotating framework with the cylinder removed.

As seen from the top view of FIG. 3, the cavities 38, 39 appear in the contour of the ink doctoring chamber 15 at each end of the inking roller. The inking roller as best seen from FIG. 2 extends at the rims 32, 33 over into the cavities. The doctor blade 25 (FIG. 3) extends beyond the ends of the inking cylinder 10, as biased downwardly in its deflected position by the preload arm 28.

Having therefore improved the state of the art, those novel features setting forth the spirit and nature of the invention are defined with particularity in the following claims.

I claim:

1. A system for inking rotary cylinders for use at a printer site, comprising in combination:

a rotary inking cylinder having a circumferential cylindrical surface to be inked, said cylinder having two cylinder ends, a contoured ink doctoring chamber mounted adjacent to and partially surrounding the cylinder to present a spaced gap 17 for introducing ink to said circumferential surface located about an arc of the cylinder surface, means for supplying a flow of ink through said gap for coating the circumferential cylinder surface, means included in said ink doctoring chamber providing a contour structured to extend the inking gap over a portion of the axial length of the circumferential surface disposed between said two cylinder ends and terminating near the ends of the cylinder to leave exposed two cylinder surface rim portions (32, 33) substantially free of ink, said chamber contour further comprising an unpressurized ink drainage cavity located beneath each of said rim portions 32, 33, and said chamber contour further comprising downwardly sloping ramps 30, 31 extending into said unpressurized cavity at each of said two cylinder ends thereby to provide an ink coating on the cylinder surface that terminates to leave said rim portions near each cylinder end uninked, a doctor blade mounted for removing excess ink from the inked cylinder surface as it rotates, and wherein said means for supplying a flow of ink comprises an ink flow system that removes ink from said cavity and recirculates that ink under pressure into said gap, said ink flow system further comprising a flow control valve for adjusting the flow of ink to replenish ink in said gap 17 at a predetermined pressure for maintaining the cylinder surface with a film of ink, said doctoring chamber further having a contour so constructed that the ink on the surface of the cylinder is confined over said portion of the axial length between said rim portions without barriers or sealing structure so that ink flows downwardly at said ramp to leave the cylinder surface rim portions substantially free of ink.

2. The system of claim 1 wherein said doctor blade further comprises a planar flexible member and said system for inking further comprising a doctor blade holder positioned in a framework for holding the blade adjacent to the cylinder to scrape ink from the cylinder at a surface position below its diameter, said framework having a ledge edge and being constructed for replaceably holding said planar doctor blade in a position slightly bent over the ledge edge, and retaining means comprising a stationary pre-loading arm pressing the doctor blade downwardly to bend it over said ledge edge.

3. In an inking system having a rotatable inking cylinder presenting a circumferential surface and two cylinder ends for depositing a film of ink on said circumferential surface, the combination comprising, a contoured ink doctoring chamber for holding and directing ink mounted adjacent to and partly surrounding said cylinder, and comprising a substantially parallel transverse portion extending axially coextensive along a portion of the inking cylinder between said two cylinder ends, said transverse portion being shorter than the cylinder to terminate at a position defining narrow rim portions of said circumferential surface adjacent each cylinder end to thereby form an ink flow path extending between the rim portions for flowing ink onto the cylinder surface, said contoured chamber forming an axial termination of said transverse portion at each end of the cylinder ends comprising downwardly extending ink return ramps, an unpressurized cavity positioned below said ramps for receiving ink from said doctoring chamber discharged from the ink flow path thereby leaving said narrow rim portions relatively free from ink without the use of barriers or other sealing structure.

4. An inking system for solving the problem of slinging ink from the ends of rotary inking cylinders in fountain type inkers, comprising in combination:

a rotary inking cylinder of predetermined length disposed about an axis of rotation and having a circumferential surface to be inked, said cylinder having two cylinder ends between which said circumferential surface is disposed, a contoured ink doctoring chamber mounted in a framework adjacent to and partially surrounding a lower portion of the circumferential surface, said chamber being shaped to provide a spaced gap for introducing a layer of ink flowing under pressure onto the circumferential surface in a flow path through the chamber, downwardly sloping ramps 30,31 extending from said framework into the doctoring chamber, an ink pumping system for passing the ink under pressure through the flow path of the chamber thereby to cover the circumferential surface with said layer of ink along a portion of the cylinder length that excludes two narrow rims at each respective cylinder end of the inking cylinder from the flow path, and structure in said doctoring chamber for excluding ink from said two narrow rims comprising an unpressured cavity resting below each of the narrow rims at the ends of the cylinder for flowing ink under pressure discharging from said spaced gap downwardly along said ramps into the unpressurized cavity without encountering the circumferential surface at the two narrow rims, thereby to leave the rims substantially free of ink without intervention of any barriers preventing flow of ink under pressure in an axial direction toward the two cylinder ends.

* * * * *